US009562280B2

(12) United States Patent
Suhonen et al.

(10) Patent No.: US 9,562,280 B2
(45) Date of Patent: Feb. 7, 2017

(54) THERMALLY SPRAYED COATING

(75) Inventors: Tomi Suhonen, Espoo (FI); Tommi Varis, Espoo (FI)

(73) Assignee: Teknologian Tutkimuskeskus VTT (FI)

( * ) Notice: Subject to any disclaimer, the term of this patent is extended or adjusted under 35 U.S.C. 154(b) by 491 days.

(21) Appl. No.: 14/007,993

(22) PCT Filed: Mar. 27, 2012

(86) PCT No.: PCT/FI2012/050304

§ 371 (c)(1),
(2), (4) Date: Oct. 31, 2013

(87) PCT Pub. No.: WO2012/131164

PCT Pub. Date: Oct. 4, 2012

(65) Prior Publication Data

US 2014/0318315 A1 Oct. 30, 2014

(30) Foreign Application Priority Data

Mar. 28, 2011 (FI) ..... 20115292

(51) Int. Cl.
*C23C 4/04* (2006.01)
*C23C 4/06* (2016.01)
(Continued)

(52) U.S. Cl.
CPC ..... *C23C 4/065* (2013.01); *C23C 4/04* (2013.01); *C23C 4/067* (2016.01); *C23C 4/08* (2013.01); *C23C 24/04* (2013.01)

(58) Field of Classification Search
CPC ..... C23C 4/04; C23C 4/06; C23C 4/08; C23C 4/073; C23C 4/12; C23C 4/126; C23C 4/129; C23C 4/131; C23C 4/134
(Continued)

(56) References Cited

U.S. PATENT DOCUMENTS 3,254,970 A 6/1966 Dittrich et al.
3,655,425 A * 4/1972 Longo ..... C23C 4/06 75/230
(Continued)

FOREIGN PATENT DOCUMENTS

EP 0459693 A1 12/1991
EP 0769568 A1 4/1997
(Continued)

OTHER PUBLICATIONS

Hai Advanced Material Specialists, Inc.; EngiCote® HA 6137 Moly-Nickel EV Series Powders; Apr. 2009; 1 page; vol. 1.1.
(Continued)

*Primary Examiner* — Helene Klemanski

(57) ABSTRACT

The present invention concerns a thermally sprayed coating, which has been applied onto the surface of the substrate as a lamellar coating. This coating is formed from a completely or partially plastisized or melted solid starting material, preferably being completely plastisized, which material contains at least one component that is capable or reacting with corroding substances and combining with them to form one or more solid product compounds. The invention also concerns the uses of such a coating and a process for producing such a coating.

12 Claims, 5 Drawing Sheets

(51) Int. Cl.
*C23C 4/08* (2016.01)
*C23C 4/12* (2016.01)
*C23C 24/04* (2006.01)

(58) Field of Classification Search
USPC ..... 75/230; 427/455
See application file for complete search history.

(56) References Cited

U.S. PATENT DOCUMENTS

| | | | | | |
|---|---|---|---|---|---|
| 3,843,334 | A | | 10/1974 | Cromwell | |
| 3,907,546 | A | * | 9/1975 | Port | C23C 4/08 427/456 |
| 4,230,748 | A | * | 10/1980 | Patel | C23C 4/08 427/455 |
| 4,507,151 | A | * | 3/1985 | Simm | C23C 4/06 428/570 |
| 4,725,508 | A | * | 2/1988 | Rangaswamy | C23C 4/06 428/403 |
| 4,999,225 | A | * | 3/1991 | Rotolico | C23C 4/129 427/455 |
| 5,063,021 | A | | 11/1991 | Anand et al. | |
| 5,302,450 | A | | 4/1994 | Rao et al. | |
| 5,690,716 | A | * | 11/1997 | Sampath | C23C 4/06 428/552 |
| 5,817,372 | A | * | 10/1998 | Zheng | C23C 4/02 427/455 |
| 6,376,103 | B1 | | 4/2002 | Sampath et al. | |
| 6,503,290 | B1 | * | 1/2003 | Jarosinski | C23C 4/08 427/455 |
| 2007/0098975 | A1 | | 5/2007 | Gill | |
| 2011/0076414 | A1 | * | 3/2011 | Ladru | C23C 4/08 427/456 |
| 2012/0020828 | A1 | * | 1/2012 | Suhonen | C23C 4/06 420/431 |

FOREIGN PATENT DOCUMENTS

| | | | |
|---|---|---|---|
| GB | 2356204 | A | 5/2001 |
| JP | H03-056609 | A | 3/1991 |
| JP | 2004/332024 | A | 11/2004 |

OTHER PUBLICATIONS

Modi et al.; A Study of High-Velocity Combustion Wire Molybdenum Coatings; Journal of Thermal Spray Technology; Sep. 2001; pp. 480-486; vol. 10 (3); ASM Internaitonal/Springer.

Oksa et al.; Combination of protective coating and temperature monitoring in boilers; Applied Materials Research at VTT, VTT Symposium 244; 2006; pp. 166-176; VTT Technical Research Centre of Finland.

Perugini et al.; Plasma-Sprayed Self-Sealing Ceramic Coatings: Materials Chemistry and High Temperature Protective Properties; Thin Solid Films; 1983; pp. 415-425; vol. 108; Elsevier Sequoia.

Turunen et al.; Parameter optimization of HVOF sprayed nanostructured alumina and alumina-nickel composite coatings; Surface & Coatings Technology; Apr. 2006; pp. 4987-4994; vol. 200, No. 16-17; Elsevier.

Zanchuk; The Use of Tafaloy 45CT, an Ni—Cr—Ti Alloy, as an Arc sprayed corrosion Barrier in High Temperature Sulurous Environments; Surface and Coatings Technology; 1989; pp. 65-69; vol. 39-40; Elsevier Sequoia.

Hwang et al.; Tribological Behvior of Plasma Spray Coatings for Marine Diesel Engine Piston Ring and Cylinder Liner; Journal of Materials Engineering and Performance; Jun. 2006; pp. 328-335; vol. 15, No. 3; ASM International.

Rastegar et al.; Alternative to chrome: HVOF cermet coatings for high horse power diesel engines; Surface and Coatings Technology; Mar. 15, 1997; pp. 156-163; vol. 90, No. 1-2; Elsevier Science S.A.

EP Application 12764399.7; filing date Mar. 27, 2012; Teknologian tutkimuskeshus VTT; European Search Report Feb. 9, 2015.

* cited by examiner

A) B)

A) B)

A) B)

A) B)

| Reference NiCr coating after KCl exposure | Cl trap layer on a NiCr coating |
| --- | --- |

THERMALLY SPRAYED COATING

FIELD OF THE INVENTION

The present invention concerns a thermally sprayed coating, which has been applied onto the surface of the substrate as a lamellar coating. Further, the invention concerns the use of such a coating in protecting against corrosion, as well as a process for producing such a coating.

DESCRIPTION OF THE RELATED ART

Previously, it has been attempted to avoid delamination of coatings due to corrosion by forming a dense coating that is as tightly attached to the surface as possible. However, thermally sprayed coatings are always lamellar (sectional), whereby this tight attachment is not as easy to achieve as with some other types of coatings. Therefore, the use of coatings applied by thermal spraying has not been common in applications required to endure highly corrosive conditions. At lower temperatures, polymer-based sealing materials have been used, but for high-temperature applications there have still been no satisfying solutions.

In corroding environments, such as environments containing e.g. chlorides or sulfides, or both, such as in engines and in energy applications (e.g. energy boilers, car engines, fuel cells), the use of thermally sprayed coatings has still become more common, due to the other advantages of thermally sprayed coatings. The biggest problem related to these coatings has been the access of the corroding substances to the substrate along the lamellar boundaries (interfaces between the sections) of the coating. In addition to leading to corrosion, this can lead to the mentioned delamination of the coating.

Similar situations occur in other types of coatings, as the interfaces between the particles of the materials used in the coatings function as the laminate edges or boundaries of the thermally sprayed coatings.

Therefore, there is a need for achieving solutions that provide a stable and tightly attached coating with all edges and interfaces protected stably and successfully from corrosion.

SUMMARY OF THE INVENTION

It is an object of the invention to produce thermally sprayed coatings that provide an efficient protection against corrosion.

It is a particular object of the invention to produce coatings having an element or a compound applied to the lamellar boundaries, which element or compound reacts with corroding substances (such as chlorides and sulfides), thereby forming solid product compounds (e.g. $MoS_2$ or $NiCl_2$, and thereby blocking their pathways).

These and other objects, together with the advantages thereof over known coatings and methods, are achieved by the present invention, as hereinafter described and claimed.

Thus, the present invention concerns a thermally sprayed coating, which has been applied onto the surface of the substrate as a lamellar coating.

Further, the present invention concerns the use of such a coating in protecting against corrosion, as well as a process for producing such a coating.

Considerable advantages are obtained by means of the invention. For example, the invention provides a coating and means of obtaining said coating, which protect the surfaces of any substrate from corrosion, even along its edges, and even along the lamellar boundaries of the coating.

DESCRIPTION OF THE DRAWINGS

FIG. 2B showing the stability of $MoS_2$ at a function of the temperature. [Thermodynamic calculation program: HSC Chemistry 6, Outotec Research Oy]

DETAILED DESCRIPTION OF THE PREFERRED EMBODIMENTS OF THE INVENTION

Figure 1:
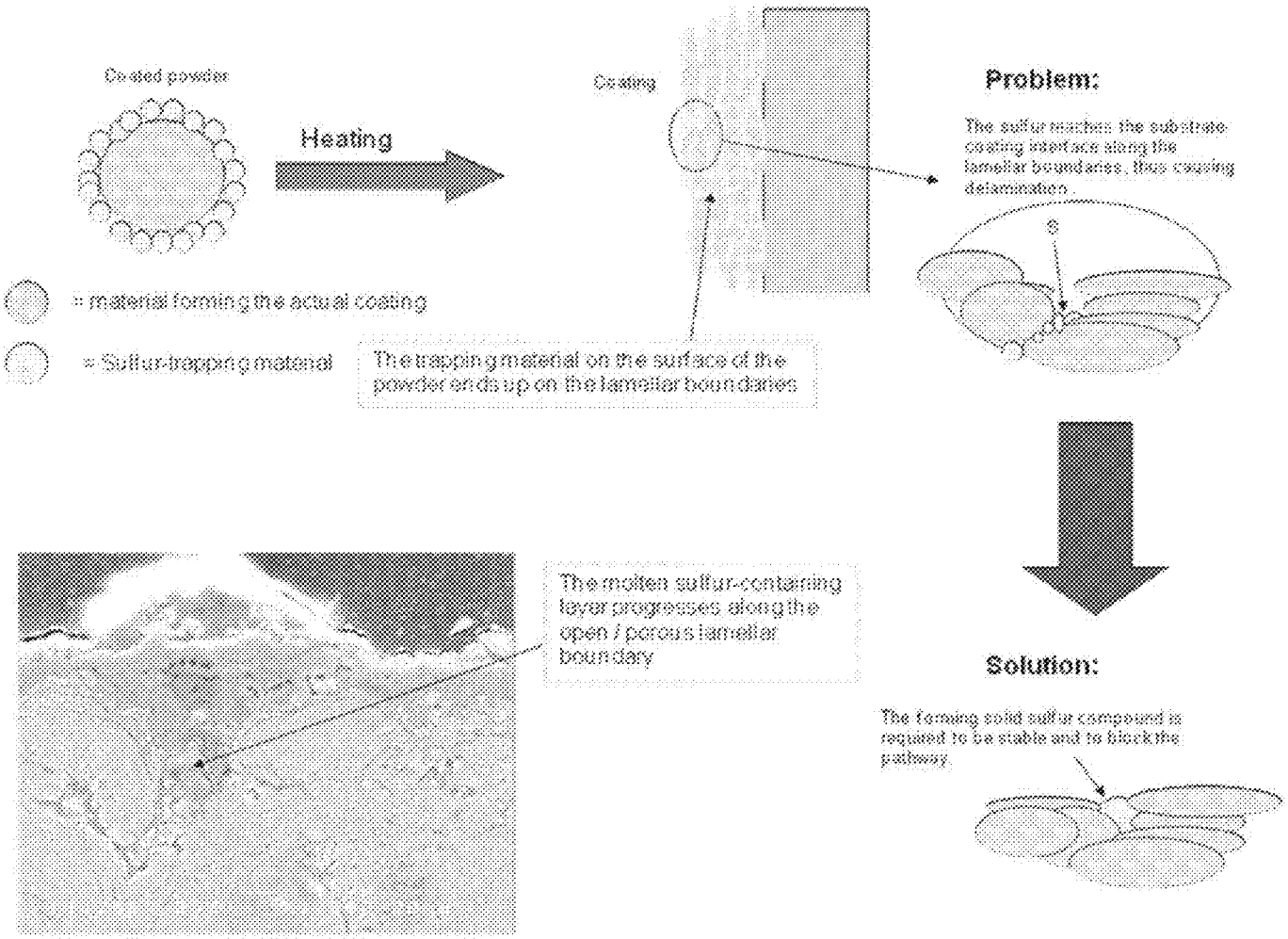
FIG. 1 is an exemplary scheme of the coating of the invention, of its formation and of the problem it solves.

The present invention concerns a thermally sprayed coating, which has been applied onto the surface of the substrate as a lamellar coating. This coating is characterized by being formed from a completely or partially melted/plastisized solid starting material, preferably being completely plastisized, which material contains at least one component that is capable of reacting with corroding substances and combining with them to form one or more solid product compounds.

Suitable substrates to be coated can be any substrates susceptible to corrosion due to the presence of corrosive elements in their environments. Particularly, the substrates are metal components. Most suitable, the substrates are components used in or in the vicinity of engines, boilers or fuel cells.

The invention also concerns a process for producing such coatings, and for applying them onto substrates.

The thermally sprayed coating is formed as incited and/or plastisized drops of the coating material are solidified on the surface of the substrate to be coated, thus forming a lamellar structure on said surface.

In the process of the present invention, thermal spraying is used to apply a completely or partially plastisized or melted solid starting material, such as a powder, onto the surface of a substrate. The surface layer of the solid starting material is capable of reacting with corroding substances and combining with them to form solid product compounds.

The solid starting material, which is completely or partially plastisized or melted during spraying, is preferably a metal, a metal alloy, a metal oxide, a ceramic compound or a polymer, or a mixture of these, whereby the metal preferably is selected from the group of Ni, Mg, Cd, Mn, Mo, Pd, Pt, W, Ir and Ta, more preferably from the transition metals of said group, the metal most suitably being molybdenum. Particularly, the solid starting material is selected from materials that form metal oxides, chlorides or sulfides or two or more of these in ambient conditions, preferably from materials forming metal sulfides, most suitably molybdenum sulfide.

In the process of the invention, the solid starting material is preferably applied onto the surface of the substrate as a mist of droplets of said completely or partially plastisized or melted solid starting material.

According to an embodiment of the invention, the solid starting material is used to form a composite powder.

According to a preferred embodiment of the invention, the solid starting material is used to form a composite powder containing a main component, which is selected from the above solid starting materials, and one or more subcomponents, also selected from the above solid starting materials. These subcomponents are herein also called "trap materials".

According to a particularly preferred embodiment, these composite powder particles are coated using one or more of these subcomponents.

According to one aspect of the present invention, the thermally sprayed composite powders, suitable for use in the present invention, are manufactured by agglomerating and sintering the different components of the composite into the same particle. The idea is to use this process to form a powder containing a mixture of the main component with the subcomponent(s), wherein the main component would be a material performing well in the corrosive conditions to be expected and the subcomponent(s) would be one or more materials having lower inciting points or lower melt viscosities.

When thermally spraying such a powder, the material having the lower melting point or the lower melt viscosity will be more easily and evenly distributed upon impact with the surface of the substrate to be coated, i.e. upon impact with the lamellar boundaries of the forming coating.

According to another aspect of the invention, the powder particles are formed from the main component and these particles are coated using the "trap material" (i.e. the subcomponents) to form a powder coating, whereby it will remain on the lamellar boundaries of the forming thermally sprayed coating (in the following, the term "coating", used alone, will refer to the thermally sprayed coating, while the powder particles may optionally be covered with a "powder coating"). As the corroding substance reaches these lamellar boundaries, the trap material reacts, thus forming a solid product compound and blocking the pathway of the corroding substance.

According to both mentioned aspects, the main component is any powder, preferably selected from alloys containing two of the mentioned metals suitable for use as the solid starting material, most suitably Ni and Cr. The number of subcomponents is preferably limited to one, which more preferably is selected from the mentioned metals suitable for use as the solid starting material, the metal most suitably being Mo or Ni.

According to one alternative of the present invention, the thermally sprayed coating is optimized for environments expected to be rich in sulfur or sulfides. An example of such a situation is engine applications. Metals forming sulfides, and thus being suitable for use in the plastisizable solid starting materials of the coatings of this embodiment include Ni, Mg, Cd, Mn, Mo, Pd, Pt, W, Ir and Ta. Preferably, the metal(s) used in the main component and the subcomponent(s) of these coatings are selected from Ni, Ni alloys and Mo. Most suitably, at least one subcomponent is molybdenum.

For example, molybdenum can be applied onto the lamellar boundaries of the coating produced from the main component onto an engine to form a solid molybdenum sulfide compound when reacting with the sulfur released during the combustion. $MoS_2$ is a tightly packed compound, but on an atomic level it is easily sliding, whereby it would guarantee its own access to every open and available position of the lamellar boundaries, thus blocking these positions. The compound is stabile and capable of formation at room temperature and even at temperatures of up to 1000° C. Thus, no corroding substance would gain access to the interfaces between the coating and the substrate to damage said substrate and possibly cause delamination of the coating.

According to another alternative of the present invention, the thermally sprayed coating is optimized for environments expected to be rich in chlorides or chlorine. An example of such a situation is energy boilers. Metals forming chlorides, and thus being suitable for use in the plastisizable solid starting materials of the coatings of this embodiment include Ni, Mg, Cd, Mn, Mo, Pd, Pt, W, Ir and Ta. Preferably, the metal(s) used in the main component and the subcomponent(s) of these coatings are selected from Ni and Ni alloys. Most suitably, at least one subcomponent is nickel.

In demanding corrosive conditions, the particle interfaces of the used materials, which correspond to the lamellar boundaries formed at thermal spraying, function as the main pathway for corrosive substances. In the case of coatings, these substances gain access to the interface between the coating and the substrate, thus causing corrosion of the substrate as well as delamination of the coating.

Thus, the idea of the present invention is to prepare thermally sprayed coatings, where elements or compounds have been applied to the lamellar boundaries of the coating to there react with corrosive substances (such as sulfides or chlorides), and form solid product compounds (e.g. $MoS_2$) that occupy these edges and block the pathway of the corrosive substances.

The main applications of the present invention are e.g. energy boilers, gas turbines, engines and other combustion applications. The applications may include any applications having surfaces requiring high-temperature corrosion protective coatings. However, the invention can also be used to manufacture coatings for other types of protection than protection against corrosion. As an example, the coating of the invention will also protect the substrate from abrasion.

The thermal spraying may include, for example, flame spraying, wire arc spraying, plasma spraying, vacuum plasma spraying, high-velocity oxy-fuel spraying (HVOF), detonation spraying and cold spraying, or any other corresponding method.

Some preferred embodiments of the invention and their advantages are further illustrated using the following examples, which are not intended to limit the scope of the invention.

EXAMPLES

Example 1

Sulfur Trapping Coating

In this example, molybdenum was selected as the trap material (i.e. the subcomponent of the coating) due to the following aspects: It forms stable $MoS_2$ in certain sulfur-containing environments, $MoS_2$ is a known solid lubricant, and $MoS_2$ is a close packed compound, where the molybdenum atoms are positioned between two levels of sulfur atom layers. These atom layers are capable of easily sliding in respect of each other, whereby the forming product compound is capable of blocking open positions of the lamellar boundaries and, thus, preventing the access of corrosive elements to the coating-substrate interface.

Figure 2:
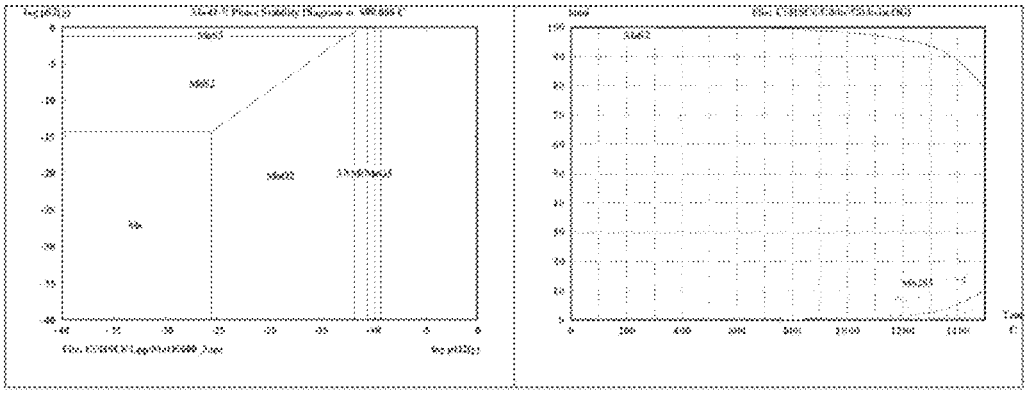
FIG. 2 is a graphical image that illustrates the reaction of molybdenum in a sulfur-containing environment, with FIG. 2A showing the reaction products of molybdenum as a function of the partial pressures of sulfur (y-axis) and oxygen (x-axis) at a temperature of 600° C.

In FIG. 2, the reactions of molybdenum in a sulfur-containing environment has been modeled (using a thermodynamic molecular modeling program, HSC Chemistry 6, Outotech Research Oy). From FIG. 2A it can be observed that $MoS_2$ is the first product compound formed between Mo and S, and from FIG. 2B it can be observed that $MoS_2$ is extremely stabile up to temperatures of almost 1000° C.

Figure 3:
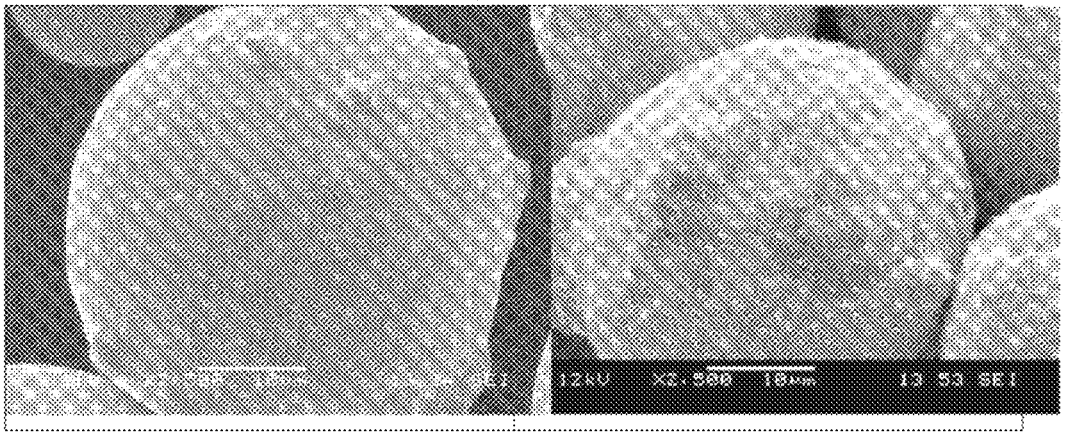
FIG. 3 is a pair of microscopic images illustrating the difference between uncoated powders and powders coated according to the invention, with FIG. 3A showing an uncoated NiCr powder and FIG. 3B showing a similar NiCr powder coated with nano-molybdenum (10 wt-%).

The function of the concept has been demonstrated using a simple laboratory test, wherein NiCr and $Cr_3C_2$—NiCr powders were coated using nano-molybdenum (the powders were milled together by using a ball mill so that the nano-Mo adhered to the surface of the NiCr or $Cr_3C_2$—NiCr powder). FIG. 3A shows the uncoated NiCr powder and FIG. 3B shows the nano-Mo-coated NiCr powder. The milling parameters of the powder were optimized for the used powders.

Figure 4:
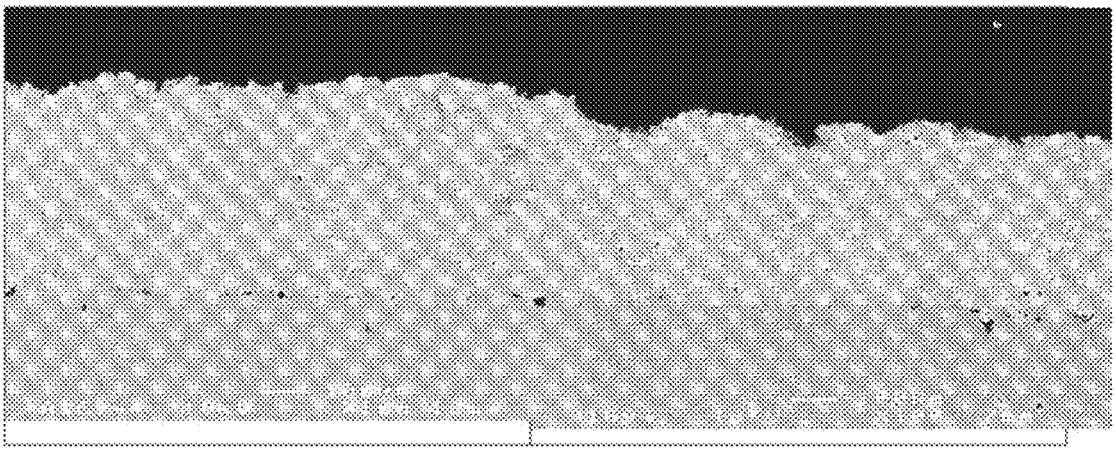
FIG. 4 is a pair of images of the surfaces of the powder particles, obtained with an electron microscope, with FIG. 4A showing the particles on the surface of a NiCr coating on a substrate and FIG. 4B showing a sulfur trapping coating (with NiCr and 10 wt-% nano-Mo), whereby the molybdenum can be seen in the image as lighter areas.

Coatings were thermally sprayed from the manufactured powders using the HVOF method. The trapping material was successfully applied to the lamellar boundaries on the substrate, as can be seen from FIG. 4.

Figure 5:
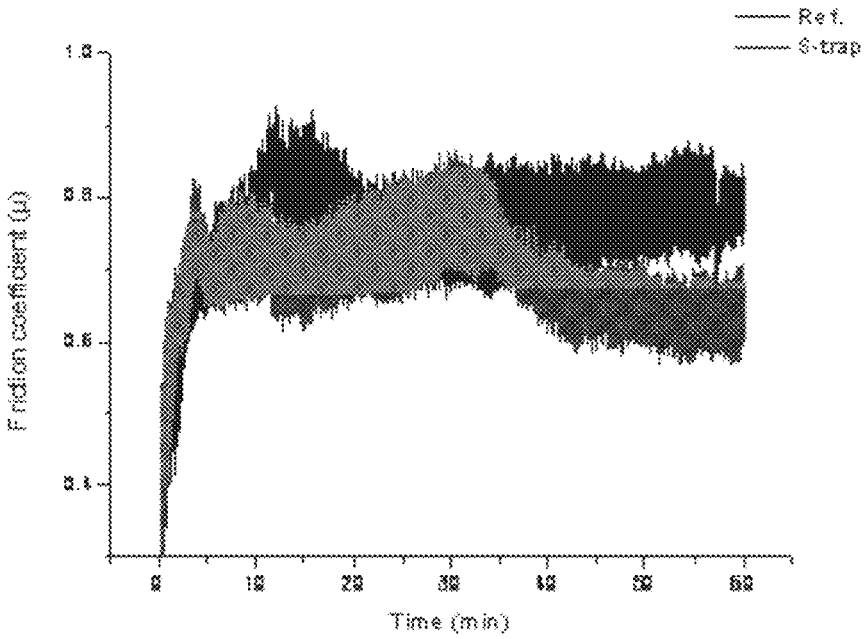
FIG. 5 is a graphical illustration of the friction coefficients of the two used exemplary materials, one being NiCr and the other being NiCr+nano-Mo (counter material: tool steel, room temperature, humidity: 50%), where the coefficient of the NiCr coating can be seen as the upper graph, while the coefficient of the Mo-containing coating can be seen as the lower graph.

The manufactured coatings (consisting of the uncoated powder and the trap-material-coated powder) were exposed to a sulfur-containing environment (a mixture of sodium sulfide-potassium sulfide is placed onto the coatings, T=650° C., where the sulfide mixture is in a molten state, and the exposure time is 1 week), after which the friction properties of the coatings were observed using a pin-on-disk-test (counter material: tool steel). The friction behavior of this sulfur trapping coating clearly differed from the coating manufactured from pure main component. The friction coefficient of the trapping coating is clearly lower and has a reducing trend, as can be observed from FIG. 5. This reducing trend of the trapping coating is considered to be due to the distribution of the $MoS_2$ also on the surface of the counter material used in the test. Typically, the trend of the friction coefficients of thermally sprayed coatings is increasing as a function of time.

Example 2

Chlorine Trapping Coating

Figure 6:
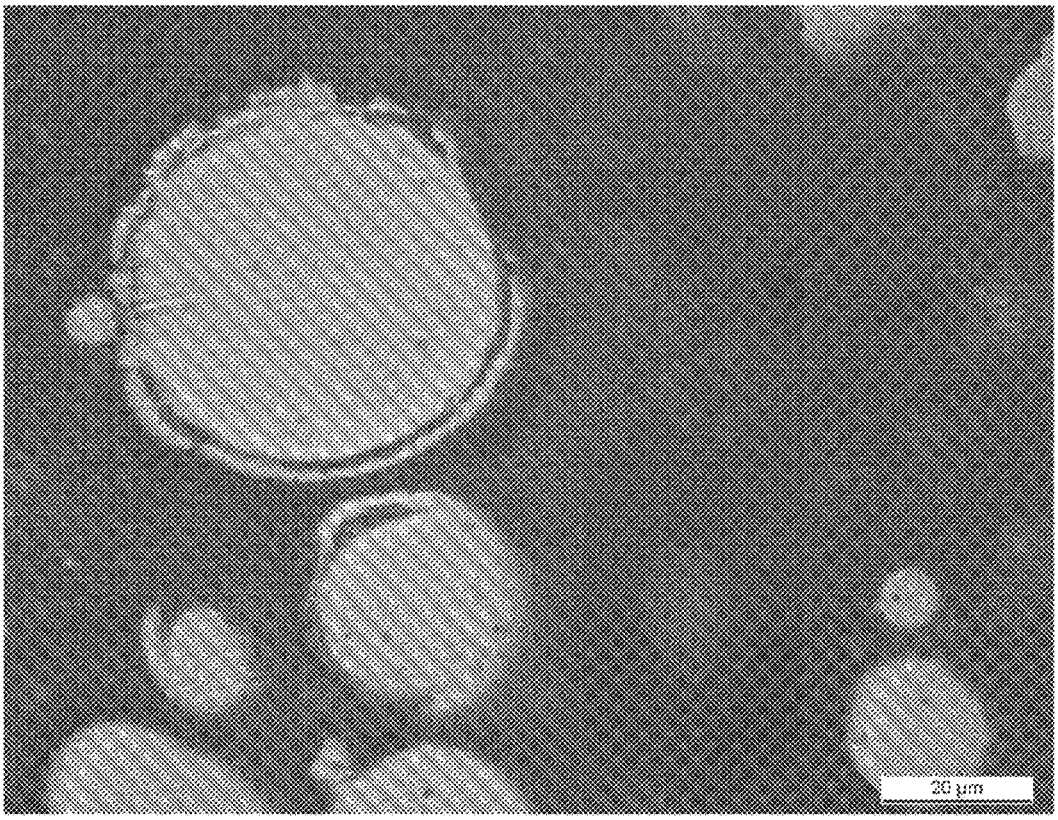
FIG. 6 is a cross-section (obtained with an optical microscope) of a NiCr powder coated with chemical nickel.

The function of the concept of Example 2 was demonstrated using a simple laboratory test, where a NiCr powder was powder coated with nano-nickel (the powders were milled using a ball mill so that the nano-Ni adhered to the surface of the NiCr powder particles). The milling parameters of the powder were optimized for the used powder. The nickel layer was achieved also on the surface of the NiCr powder particles using a chemical, i.e. autocatalytic, coating procedure. The precipitating powder coating is, however, not pure nickel, but contains about 2-14% of phosphorous, depending on the used dipping procedure, and requires an "activating" treatment prior to coating of the powder particles, due to the passive surface of the NiCr powder. FIG. 6 shows the cross-section of the NiCr powder particles coated with chemical nickel.

Figure 7:
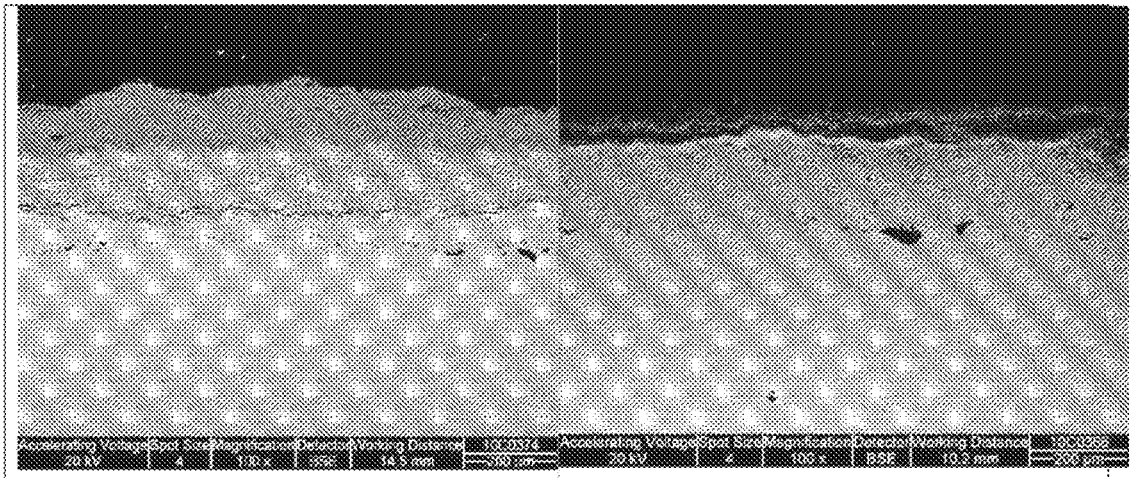
FIG. 7 is a pair of SEM images of the powder particles of the invention, with FIG. 7A showing the image of a cross-section of a NiCr coating after an exposure test and FIG. 7B showing the image of a cross-section of a chlorine trapping coating (with NiCr and chemical Ni) after an exposure test.

The function and effectiveness of the layer of chemical nickel in a chlorine-containing environment was demonstrated using coating layers. The NiCr coatings were applied for the two different tests using a HVOF procedure, after which one of the NiCr coatings was further coated using a chemical nickel layer, this further coating corresponding to the above described powder coating using a trapping subcomponent. The NiCr without further coating and the chlorine trapping NiCr—Ni coating (NiCr+chemical Ni) were exposed to a high-temperature chlorine corrosion test (the surfaces of the coatings were covered with 100% KCl, at a temperature of 600° C., for an exposure time of 168 h). FIG. 7A shows the cross-section of the pure NiCr coating after the exposure test, and shows how the corrosive substance has advanced along the lamellar boundaries of the coating almost all the way to the substrate.

The elemental composition map obtained using an energy-dispersive detector (EDS) of a scanning electron microscope reveals that the formed thin protecting layer ($Cr_2O_3$) has not been able to prevent the advancement of the chlorine to the lamellar boundaries. The EDS also reveals that vast amounts of chlorine, but no oxygen, are found from the almost loose lamellar boundaries. FIG. 7B presents the cross-section of the chemical-nickel-coated NiCr coating after the exposure test. As can be seen from the figure, the chlorine has not been able to penetrate through the layer, except in the right corner of the image, where the layer of chemical nickel is discontinuous. At these discontinuous positions, chlorine corrosion has taken place at the lamellar boundaries.

The invention claimed is:

1. A thermally sprayed coating, which has been applied onto the surface of a substrate as a lamellar coating, wherein it has been formed from a completely or partially plastisized or melted solid starting material, which is in the form of a coated composite powder containing a main component selected from metal alloys, which has been coated with nanoparticles of one or more subcomponents selected from metals, which metals are selected from the group consisting of Ni, Mg, Cd, Mn, Mo, Pd, Pt, W, Ir and Ta, whereby the coated composite is capable of reacting with corroding substances and combining with them to form one or more solid product compounds.

2. The coating of claim 1, wherein the solid starting material consists of a powder, which has been plastisized or melted completely or partly prior to application onto the substrate, and which, once applied, forms a plastic or adhesive coating on the substrate.

3. The coating of claim 1, wherein the solid starting material is a powder, which consists of agglomerated and sintered composite particles.

4. The coating of claim 1, wherein the thermally sprayed coating is optimized for environments expected to be rich in sulfur or sulfides.

5. The coating of claim 1, wherein the thermally sprayed coating is optimized for environments expected to be rich in chlorine or chlorides, the metal(s) of the solid starting materials being selected from metals forming chlorides.

6. The coating of claim 1, wherein in ambient conditions it forms metal oxides, chlorides or sulfides or two or more of these.

7. A process for producing a coating, which protects against corrosion on the surface of a substrate comprising the steps of applying a completely or partly plastisized or melted solid starting material, which is in the form of a coated composite powder containing a main component selected from metal alloys, which has been coated with nanoparticles of one or more subcomponents selected from metals, said metals being selected from the group consisting of Ni, Mg, Cd, Mn, Mo, Pd, Pt, W, Ir and Ta, onto the surface of a substrate by thermal spraying, which solid starting material reacts with corrosive substances in the surrounding environment and combining with them to form one or more solid product compounds.

8. The process according to claim 7, further comprising agglomerating and sintering the coated composite particles of the solid starting material prior to application onto the substrate surface.

9. The process according to claim 7, further comprising applying the solid starting material onto the surface as a mist formed from the powder, wherein the powder has been at least partly plastisized or melted.

10. The process according to claim 7, wherein the thermal spraying is any of; flame spraying, wire arc spraying, plasma spraying, vacuum plasma spraying, high-velocity oxy-fuel spraying (HVOF), cold spraying or detonation spraying.

11. A thermally sprayed coating, which has been applied onto the surface of a substrate as a lamellar coating, wherein it has been formed from a completely or partially plastisized or melted solid starting material, which is in the form of a coated composite powder containing a main component that is an alloy comprising nickel and chrome, which has been coated with a coating of nickel or molybdenum.

12. The thermally sprayed coating of claim 1, wherein the main component is an alloy comprising nickel and chrome, and wherein the main component has been coated with nanoparticles of Ni or Mo.

* * * * *